US005114074A

United States Patent [19]

Frauenthal et al.

[11] Patent Number: 5,114,074

[45] Date of Patent: May 19, 1992

[54] RETRACTION RESISTANT STRAW

[76] Inventors: Ellen S. Frauenthal; Leonard A. Silverstein, both of 1084 Bailiff Ct., Atlanta, Ga. 30319

[21] Appl. No.: 566,517

[22] Filed: Aug. 13, 1990

Related U.S. Application Data

[63] Continuation-in-part of Ser. No. 508,267, Apr. 11, 1990, abandoned.

[51] Int. Cl.[5] ..... A47G 21/18

[52] U.S. Cl. ..... 239/33; 215/1 A

[58] Field of Search ..... 239/33; 222/90, 464, 222/569; 215/1 A

[56] References Cited

U.S. PATENT DOCUMENTS

| | | | |
|---|---|---|---|
| 1,034,837 | 8/1912 | Rollefson | 239/33 |
| 2,646,311 | 7/1953 | Jones | 239/33 |
| 2,689,149 | 9/1954 | Saltzman | 239/33 |
| 3,099,565 | 7/1963 | Neuhauser | 239/33 |
| 3,106,312 | 10/1963 | Hitchcock | 215/1 A |
| 3,409,224 | 11/1968 | Harp et al. | 239/33 |
| 4,733,785 | 3/1988 | Turner, Jr. et al. | 239/33 |

FOREIGN PATENT DOCUMENTS

| | | | |
|---|---|---|---|
| 1180572 | 12/1958 | France | 215/1 A |
| 1445639 | 6/1966 | France | 215/1 A |

*Primary Examiner*—Andres Kashnikow
*Assistant Examiner*—Christopher G. Trainor
*Attorney, Agent, or Firm*—Jones, Askew & Lunsford

[57] ABSTRACT

A retraction resistant straw of a generally cylindrical construction having a retaining tab having one edge secured to the outer periphery of the cylinder of the straw substantially parallel to the cylinder's longitudinal axis. A retaining edge from the tab extends radially from the cylinder. The tab is flexible and may be laid about the outer periphery of the straw when same is inserted into a disposable juice carton, and will return to a relaxed position so that the retaining surface will engage the inside of the upper wall of a juice carton when a child or other user attempts to retract same. An alternate embodiment having a circular retaining edge which is the bottom of a truncated cone coaxial with the straw is also shown.

3 Claims, 2 Drawing Sheets 12
10
32
19
30
18
31
11

12
19
17
10
16
18
20
11
15
22

22
19
10
18

21
25
35
32
30
10
32
35
18
22
26
18
12
19

RETRACTION RESISTANT STRAW

CROSS REFERENCE TO RELATED APPLICATION

The present application is a continuation in part of the applicant's co-pending application Ser. No. 508,267 entitled "Retraction Resistant Straw" filed Apr. 11, 1990, now abandoned.

TECHNICAL FIELD

The present invention relates to drinking straws and in particular is an improved drinking straw which is retraction resistant when used in combination with a drink container having an orifice of the type with a perforationable seal thereover which orifice is sized to accept a drinking straw of a predetermined diameter.

BACKGROUND OF THE INVENTION

For many years in the industrialized world, fruit juices and sugared fruit punches have been staple drinks for children at meal times, snacks, and after vigorous exercise. For many years, spilled juice has stuck to hundreds of kitchen and playroom floors drawing bugs, creating messes, and causing numerous problems for the parents of juice drinking children.

Recent developments in container technology in drink processing have led to the widespread use of disposable cardboard containers for drinks for children and adults. The most popular of these are individual serving sized containers for juices and punches. The contents are processed for storage without refrigeration. The containers generally are made of a laminate of cardboard and plastic or impregnated cardboard and paper which allows the juice to be stored and also allows the container to be immersed in liquid, such as the water which results from melting ice in a cooler, without unduly saturating and weakening the container. Such containers are also used for ultra high temperature (UHT) processed milk which may be stored for long periods of time at room temperatures.

Such cartons are normally constructed with an orifice sized to fit a straw of predetermined diameter. The orifice is normally sealed by flexible metal foil, which foil is made from one layer of the laminate from which the carton is constructed.

For the sake of convenience and portability, drinks packaged in such individual serving size containers are normally accompanied by a flexible straw sized to fit into the access orifice of the carton. Since there is a tradeoff between ease of access to the carton and the integrity of the seal at the access orifice prior to use, it is common to find such straws having diagonal cuts on one end to provide a point to assist in penetration of the foil seal.

As all parents who have dealt with such juice containers in the hands of small children know, drinking from a straw inserted into such a container is an acquired skill. In particular, as the use of such containers has become more prevalent, people have learned to take advantage of their convenience and often use them in outdoor settings after organized sporting activities, for picnics, and the like. The problem which gave rise to the present invention is the propensity of children to withdraw the straws from these containers at inopportune times, which often results in further problems.

The most common further problem is the dropping of the straw onto some unsanitary surface such as the ground or the floor. Additionally, loss of the straw is not uncommon.

Another problem arises when children try to reinsert the straws into such containers. This often creates a duplication of a problem which arises on the initial insertion of the straw, i.e., the child squeezing the container vigorously causing juice to be ejected through the orifice or the inserted straw on to the child's clothing or some other inappropriate receptacle for the carton's contents.

Thus, there is a need in the art, which is fully appreciated by parents of young children, to provide a straw which is resistant to retraction from a standard disposable juice carton, particularly when used by children.

Additionally, similar problems can arise when using disposable cups with perforated lids for receiving straws, such cups being of the type in which drinks are commonly dispensed by fast food restaurants. In recent years, increased awareness, as well as increased legislation, has led to widespread use of restraining devices for small children riding as passengers in automobiles. Many parents today place their children in the rear seat of an automobile in a restraining safety device to maximize the probability that the child will survive a crash of an automobile. As parents who have dealt with such devices know, dropped toys, straws, and the like usually lead to circumstances in which the child cannot reach the dropped item and the parent cannot, due to either the required contortions or inattention to the road, retrieve the dropped item for the child until the trip is over. Thus, there is a like need for a retraction resistant straw which can be used in conjunction with perforated cup tops and virtually any device having a relatively small orifice or split perforation for accepting a straw.

SUMMARY OF THE PRESENT INVENTION

The present invention essentially comprises an improvement to a drinking straw comprising flexible restraining device which may be folded against or laid down on the outer periphery of the straw when it is inserted into an orifice of a predetermined size, normally in a disposable juice carton. In its most pertinent part, the present invention comprises a straw of conventional cylindrical construction having a flexible retaining surface at least a portion of which is located a predetermined distance from the cylindrical surface of the conventional portion of the straw. Preferred forms of the present invention include a flexible tab having an upper surface forming the flexible retaining surface, and a truncated cone attached to the outer surface of the cylindrical straw, the larger diameter end of which forms the flexible retaining surface. In one preferred form, one side of the cylindrical tab is disposed along the periphery of the straw, substantially parallel to the longitudinal axis of a cylinder. The second edge of the tab extends substantially radially from the cylinder. This second edge forms a retaining surface which will engage the interior surface of a typical disposable juice carton if any attempt is made to retract the straw after insertion.

The most preferred form of the present invention is one in which the above mentioned tab is substantially in the form of a right triangle such that the hypotenuse forms a cam surface for engaging the edge of an orifice in a carton into which the straw is inserted. However, the triangular shape is not critical, and the most preferred mechanism for insertion of the straw is to make the tab flexible so that it may be wrapped around the periphery of the straw during insertion, yet resilient enough to return substantially to its relaxed position wherein the top edge of the tab will extend radially from the cylinder.

According to an alternate preferred form of the invention the flexible retaining surface is in the form of a circular surface, the center of which forms a point on the longitudinal axis of the body of the straw. Its most preferred form is formed by the larger end of a downwardly pointing (when the straw is inserted into a container) truncated cone, the smaller end of which is attached to a portion of the cylindrical body of the straw. Additional support is provided in one embodiment by tabs extending between the cylindrical surface of the straw and the interior surface of the truncated cone.

It is an object of the present invention to provide a drinking straw which is resistant to extraction, once inserted into a relatively small orifice in a drinking container, particularly that of a selectively perforatable orifice commonly used in disposable juice cartons.

It is a further object of the present invention to provide a retraction resistant straw which will significantly diminish the probability of children losing the straw during use with a disposable juice or milk carton, or other container, or dropping the straw onto an unsanitary surface, retrieving same and reinserting it into the drink container.

It is still a further object of the present invention to allow parents to feed their children juice from disposable juice cartons without being driven to utter distraction by children's propensity to lose straws or drop same in the dirtiest possible location.

That the present invention meets these objects, and overcomes the drawbacks of the prior art noted hereinabove will be appreciated from the detailed description of the preferred embodiment.

DETAILED DESCRIPTION OF THE PREFERRED EMBODIMENT

Figures 1, 2, 3, 4, 5:
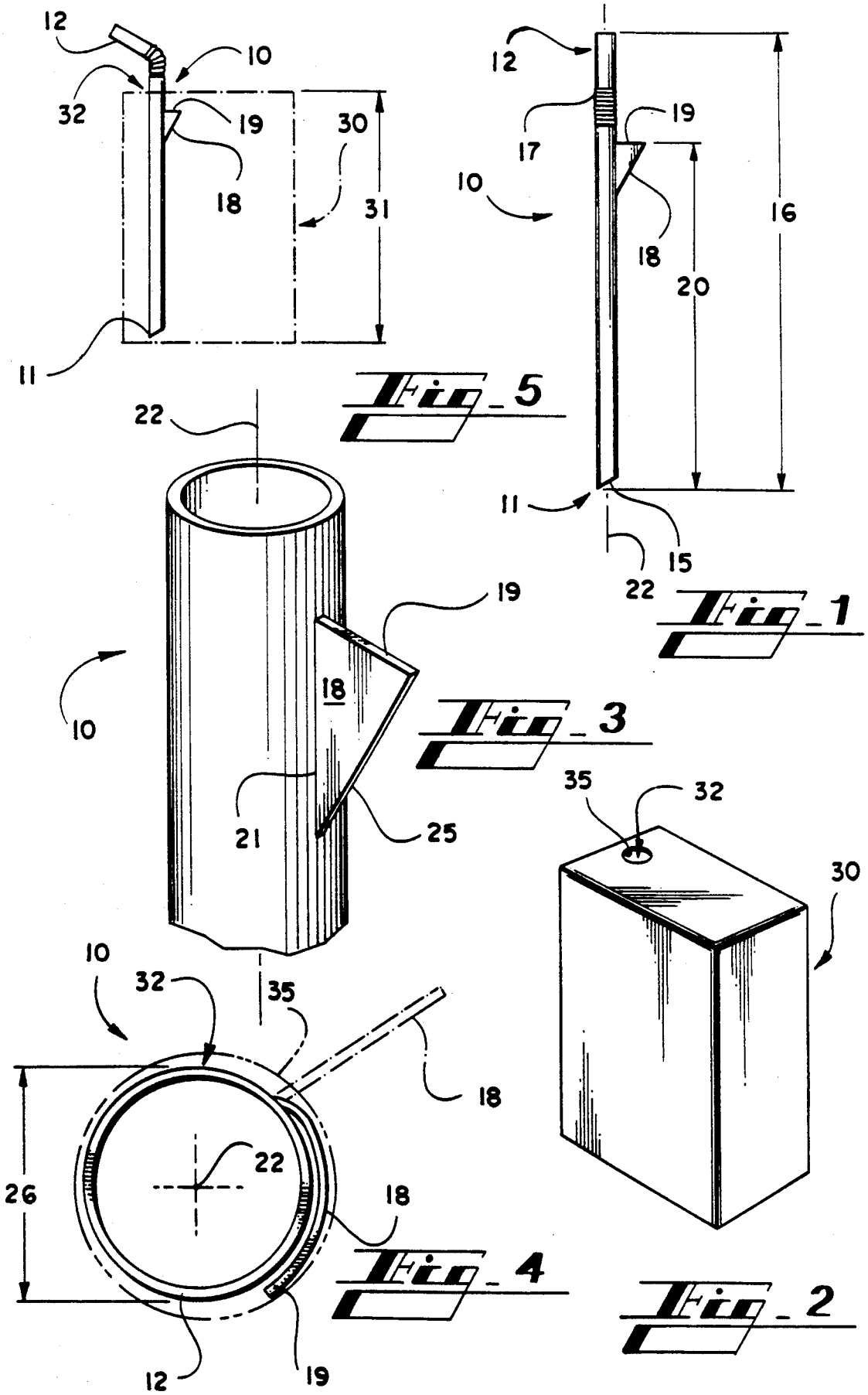
FIG. 1 is a side elevational view of the first preferred embodiment of the present invention.
FIG. 2 is a pictorial view of a typical disposable juice container with which the present invention is designed to be used.
FIG. 3 is a detail view of a portion of the first preferred embodiment of FIG. 1.
FIG. 4 is a top plan view of the first preferred embodiment showing folding of the retaining tab during insertion of the straw into a carton such as that shown in FIG. 2.
FIG. 5 is an elevational sectional view of the carton of FIG. 2 with the first preferred embodiment inserted therein.

Turning next to the drawing figures in which like numerals reference like parts, the preferred embodiment of the present invention will now be described.

FIG. 1 shows the preferred embodiment of the retraction resistant drinking straw of the present invention. The cylindrical main body of the straw is indicated generally at 10. Most of the straw is of conventional construction including an elongated cylindrical tube having a first end indicated at 11. In the preferred embodiment, the straw is cut at first end 11 at an acute angle with respect to the longitudinal axis 22 of the cylinder of the straw so as to form a point to assist in perforation of a sealed opening in a disposable juice carton, described in greater detail hereinbelow. The formation of such ends is well known to those skilled in the art, and familar to users of such straws. It is essentially analogous to the end of a hypodermic needle in form and function.

A second end 12 is for placing in the user's mouth during drinking through the straw. The straw is shown as having a characteristic length indicated by dimension line 16.

The straw includes a conventional grooved flexible portion 17, of a type typically found in selectively bendable thermoplastic straws which may be bent without constricting the fluid flow path. Such a flexible section is a feature of the preferred embodiment, but is in no way essential for practice of the present invention.

A right triangular tab indicated at 18 is attached to the straw 10 and a retaining surface 19 on the upper portion of the tab extends radially from the cylinder. In the preferred embodiment, the distance from first end 11 to retaining surface 19 is indicated by dimension line 20.

FIG. 2 shows a typical disposable juice carton 30 with which the preferred embodiment of the present invention was principally designed to be used. Such cartons are known to be constructed of laminates of cardboard, metallic foil, and are often lined with some form of plastic material to prevent saturation of the paper layers of the laminate. Such cartons typically include an orifice shown at 32 and defined by circumferential edge 35 which is often sealed with a selectively perforationable covering of metallic foil or thermoplastic material.

As is well known to those skilled in the art and users of these devices, the access orifice 32 is designed to be punctured by first end 11 of the straw 10 shown in FIG. 1.

FIG. 3 shows a detail of the preferred embodiment. In FIG. 3, it can be seen that edge 21 of tab 18 is secured to the outer periphery of the cylindrical section 10 of the straw of the preferred embodiment. It is substantially parallel to longitudinal axis 22. It should be noted that longitudinal axis 22 is defined when the segments joined by flexible portion 17 (FIG. 1) are aligned.

Retaining tab 18 is essentially in the form of a right triangle with orthogonal sides 19 and 21 and hypotenuse 25. The hypotenuse side 25 acts as a cam surface to allow easy insertion of the straw into an orifice 32 of juice carton 30.

During use, the preferred embodiment is operated as follows. This may be understood best in connection with the view of FIG. 4 which is a top plan view of the straw as it is being inserted into orifice 32. As noted hereinabove, orifice 32 is defined by circumferential edge 35. The straw is typically inserted with the first end 11 used to puncture the foil covering (not shown) of orifice 32 in a conventional manner as prior art straws are inserted into such cartons. As the straw advances longitudinally into the carton, the user should wrap retaining tab 18 about the periphery of the straw in order to allow it to pass within the confines of circumferential edge 35. This state of the straw, as retaining surface 19 is about to pass through the top surface of the juice carton into which orifice 32 is cut, is illustrated in FIG. 4. In FIG. 4 dimension line 26 indicates a predetermined diameter for the straw of the preferred embodiment which, as may be seen, is less than the diameter of circumferential edge 35 defining orifice 32.

In practice, the preferred form of the present invention in which retaining tab 18 is triangular will operate as follows. When slanted edge 25 first encounters circumferential edge 35 of orifice 32 it will, due to its geometry, bend in a manner which causes the tab to become wrapped about the outer periphery of straw 10. Thus, it is not an essential step in the operation of the straw of the preferred embodiment to perform the separate step of wrapping tab 18 around the periphery of the straw. This is extremely helpful in allowing small children to use the preferred embodiment.

Once the straw is inserted to a position such as that shown in FIG. 5, the flexible retaining tab 18 will return to its relaxed position at which it extends substantially radially from the cylindrical portion 10 of the straw. This position is shown in phantom in FIG. 4.

FIG. 5 is an elevational sectional view of the straw inserted into box 30 with tab 18 returned to its relaxed position. As may be seen from inspection of FIG. 5, retaining surface 19 will engage the top of box 30 at any time the user attemps to retract the straw. While it is not retraction proof, it has been found to be quite resistant to retraction, particularly the sort of mindless retraction often performed by children whose attention is diverted to something else during the act of drinking juice from such a carton.

Naturally, when designing embodiments of the present invention for use with particular cartons, the distance from retaining surface 19 to first end 11 of the straw, indicated at 20 in FIG. 1, should be less than predetermined insertion depth 31 which the straw must be able to reach in order to allow drinking of substantially all of the contents of the container.

Figure 8:
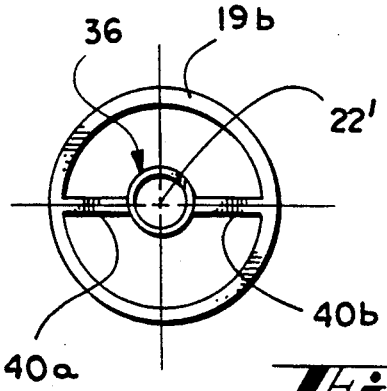
FIG. 8 is a top plan view of the alternate embodiment of FIG. 7.
Figure 7:
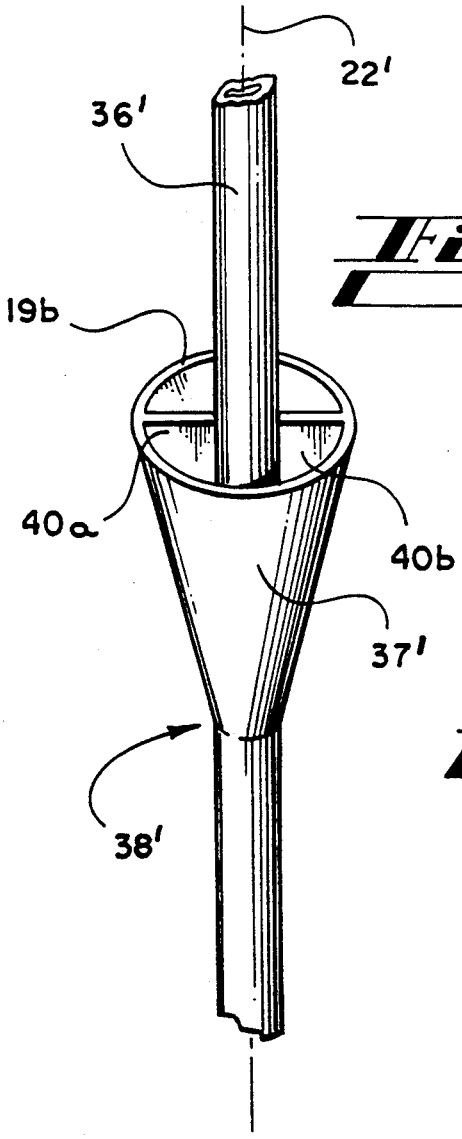
FIG. 7 is an elevational view of an alternate embodiment of the present invention.
Figure 6:
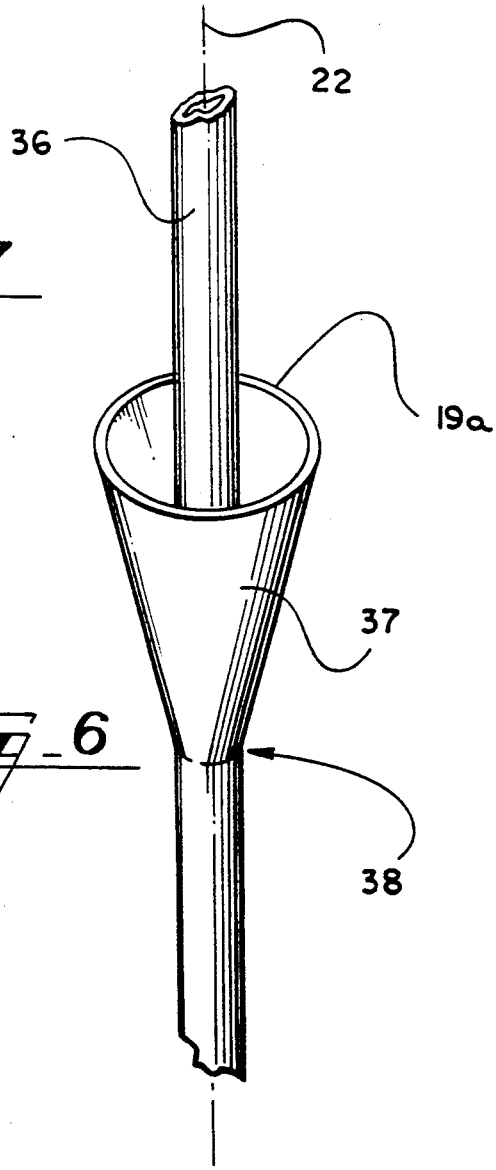
FIG. 6 is an elevational view of a second preferred embodiment of the present invention.

Turning next to FIGS. 6 through 8 alternate embodiments the present invention in which the flexible retaining surface is of circular form are shown. FIG. 6 shows upper and lower portions of the conventional cylindrical portion of the straw with the ends cut away. The outer periphery of the conventional portion of the straw forms a cylindrical surface shown at 36. The flexible retaining surface is circular in form and shown at 19*a*. It is connected to cylindrical surface 36 by a member 37 having the shape of a truncated cone, the vertical axis of which is colinear with longitudinal 22' of the straw. The periphery of the smaller end of the truncated cone is connected to cylindrical surface 36 at a circular line indicated at reference numeral 38 in the drawing figure.

FIGS. 7 and 8 show an alternative embodiment which is the embodiment of FIG. 6 modified by the inclusion of flexible tabs 40*a* and 40*b* connected between cylindrical surface 36' prime and the interior of truncated conical member 37' prime. Conical member 37' prime is likewise joined to the surface 36' prime at 38' prime. FIG. 8 is a top view of the straw FIG. 7.

The need for the present invention was first understood in the context of the types of straws used for disposable juice cartons, as described herein. However, it is the structure of the straw itself which constitutes the present invention. It will be apparent that the straw is useable with other apparatus such as cups with permanent or disposable lids. For example, disposable plastic lids commonly used on cups in fast food restaurants have a straw accepting opening in the form of a pair of orthogonal slits. The straw simply bends material adjacent the slits downward when it is inserted through the lid. The present invention would also work to discourage retraction of a straw from such a lid, although the gripping strength of the lid to the lip of the cup is what will ultimately determine the integrity of the entire structure and its resistance to disassembly by children.

The inventors of the present invention have constructed an embodiment of same using a conventional disposable straw provided with a conventional disposable juice carton of the type described herein where a slit was made in the outer periphery of the straw, said slit being substantially parallel to the longitudinal axis 22 of the straw. A triangular piece of thermoplastic material was cut from another straw and inserted through the hole, and secured with tape in a manner to make a working embodiment of the present invention.

While the inventors of the present invention are not skilled mechanical engineers, it is their belief that the best mode of carrying out the present invention is to injection mold the straw from thermoplastic material so that it is of unitary construction. Of course, other methods of making embodiments of the present invention could be employed such as ultrasonic welding of retaining tabs and the like. However, it is believed that rapid and efficient molding is the best way of carrying out the invention in an economic manner. It is believed by the inventors of the present invention that all embodiments shown herein may be formed by injection molding with a two part mold since there are no surfaces or elements of the embodiment shown herein which would inhibit separation of a conventional two part mold.

Of course, embodiments of the present invention may be constructed with multiple retaining tabs. The basic tradeoff in going from a single tab to multiple tabs is increased resistance to retraction, at the cost of a somewhat more complex insertion procedure which may cause difficulty for small children. The inventors of the present invention have constructed both single and dual tab embodiments and have found that same work very well, in a test with an actual child.

While the first preferred form of the present invention is one in which retaining tab 18 is of a substantially right triangular geometry, it will be quickly appreciated by those skilled in the art that this is not an essential geometric feature. The only critical aspect of such embodiments of the present invention is that a retaining surface such as surface 19 be constructed in a manner in which the retaining surface is sufficiently flexible to allow same to be passed through an opening of a known size, such as opening 32, and to return to a relaxed position at which surface 19 will tend to engage the upper surface of a juice carton or similar container. Thus, embodiments of the present invention could be constructed using, for example, rectangular retaining tabs. The principal drawback of same would be the requirement of the user's ability to wrap the tab about the periphery of the straw, as shown in FIG. 4, without the assistance of the cam surface action of slant side 25 of the tab having the preferred triangular shape.

It is preferable that retaining surface 19 extend radially from the straw, although as long as it is substantially radial with respect to the cylindrical portion of the straw, successful embodiments of the present invention may be constructed. Indeed, a rather significant acute angle between retaining surface 19 and the second end 12 of the straw may be tolerated in practical embodiments of the present invention.

The embodiments of FIG. 6 through 8 have the disadvantage of being somewhat more complicated in structure and possibly more difficult to insert into an orifice of limited size. However, they have the advantage of not presenting the potential problem of being difficult to package in a plastic or cellophane sleeve of the type commonly used to package straws for distributable disposable juice containers. The flexible truncated cones will need to be crushed or folded down to some degree to insert them into a relatively small orifice of a juice carton. However, the conical shape employed would not tend to tear the packaging for the straw itself as pointed tabs of the type shown in the first preferred embodiment may.

Additionally it is believed the alternate embodiments of FIGS. 6 through 8 are superior to the first preferred embodiment in applications such as use with slotted tops used on drink cups by fast food restaurants. The conical shape of the member connecting the flexible surface 19*a* and 19*b* tend to assist in insertion of the straw by pushing aside the tabs formed by the cross slits of such a top. The circular flexible retaining surface can not be withdrawn through a single slit as may be the case with the first preferred embodiment used with such a cup top.

In view of the foregoing description of the preferred embodiments of the present invention, other embodiments may suggest themselves to those skilled in the art and therefore the present invention is being limited only by the claims below.

We claim:

1. A drinking straw of the type constructed of a cylindrical tube having characteristic first and second ends of said tube and a characteristic longitudinal axis, said first end being adapted for insertion into an orifice of a substantially predetermined diameter greater than a characteristic diameter of said cylindrical tube, wherein the improvement comprises in combination:

a flexible substantially right triangular tab having one orthogonal side thereof secured to the periphery of said cylindrical tube along a line substantially parallel to said longitudinal axis such that the vertex between said one orthogonal side and the hypotenuse of said triangle is closer to said first end of said cylindrical tube than to said second end and the other orthogonal side of said triangular tab extends substantially radially from said cylindrical tube when in a relaxed position, said right triangular tab being sufficiently resilient to substantially return to said relaxed position after being selectively wrapped about said periphery of said cylindrical tube and inserted through said orifice.

2. A drinking straw as recited in claim 1 wherein:

a distance measured from the said first end of said cylindrical tube to the other orthogonal side of said triangular tab is less than a predetermined insertion depth.

3. A drinking straw of the type constructed of a cylindrical tube having a characteristic cylindrical surface and a characteristic longitudinal axis, wherein the improvement comprises in combination:

a flexible retaining surface connected to said cylindrical surface at least a portion of which is disposed a predetermined distance radially away from said cylindrical surface so as to remain said predetermined distance from said cylindrical surface in the presence of a downward force parallel to said longitudinal axis acting on said retaining surface; and said flexible retaining surface is substantially circular and is connected to said cylindrical surface by a flexible member forming a truncated cone, the smaller end of which is disposed around and connected to said cylindrical surface.

* * * * *